US005767471A

United States Patent [19]

Blatter et al.

[11] Patent Number: 5,767,471

[45] Date of Patent: Jun. 16, 1998

[54] PRESSURIZED GAS CIRCUIT-BREAKER

[75] Inventors: Johannes Blatter, Gretzenbach; Fabrizio Sciullo, Oensingen, both of Switzerland

[73] Assignee: GEC Alsthom T & D AG, Oberentfelden, Switzerland

[21] Appl. No.: 768,397

[22] Filed: Dec. 18, 1996

[30] Foreign Application Priority Data

Dec. 21, 1995 [EP] European Pat. Off. ..... 95120347

[51] Int. Cl.[6] ..... H01H 33/88

[52] U.S. Cl. ..... 218/60; 218/57

[58] Field of Search ..... 218/1, 7, 8, 13, 218/14, 43, 51, 52, 56, 57, 59, 60, 61, 66, 68, 78, 84, 86, 88, 154, 155

[56] References Cited

U.S. PATENT DOCUMENTS

| | | | |
|---|---|---|---|
| 4,041,264 | 8/1977 | Grune | 200/148 R |
| 4,160,888 | 7/1979 | Natsui et al. | 200/148 A |
| 4,182,942 | 1/1980 | Koyanagi et al. | 200/148 A |
| 4,230,920 | 10/1980 | Thaler | 200/148 A |
| 4,275,431 | 6/1981 | Swoish et al. | 361/93 |
| 4,354,081 | 10/1982 | Noeske | 200/148 A |
| 4,389,554 | 6/1983 | Freeman | 200/148 A |

FOREIGN PATENT DOCUMENTS

| | | | |
|---|---|---|---|
| 0049375A1 | 4/1982 | European Pat. Off. | H01H 3/60 |
| 0664552A1 | 1/1995 | European Pat. Off. | H01H 33/91 |
| 2246048 | 4/1975 | France | H01H 33/91 |
| 2566575A1 | 12/1985 | France | H01H 33/00 |
| 2922913A1 | 6/1979 | Germany | H01H 33/58 |
| 3215243A1 | 4/1982 | Germany | H01H 33/915 |
| 3041801A1 | 6/1982 | Germany | H01H 33/82 |

*Primary Examiner*—Michael L. Gellner
*Assistant Examiner*—Michael A. Friedhofer
*Attorney, Agent, or Firm*—Sughrue, Mion, Zinn, MacPeak & Seas, PLLC

[57] ABSTRACT

In a pressurized gas circuit-breaker the mobile contact member is fixed to a connecting rod that passes coaxially through the fixed braking cylinder. The braking cylinder has transverse walls at both ends so as to delimit a cylinder. The connecting rod has a drive abutment that drives the braking piston in a final section of the opening travel, which increases the pressure in the first sub-space and reduces the pressure in the second sub-space. The braking piston is disposed on a bush around the connecting rod, the bush and the connecting rod delimiting an annular cylinder space between the drive member and a counter-abutment on the bush, a pressure being generated when the circuit-breaker opens. In this way a high braking force with no impact is very rapidly obtained.

14 Claims, 3 Drawing Sheets

98
34
38
70
30
40
B
68
16
18
48
46
50
44
58
36
60
42
64
66
32
10
28
26
52
54
56
62

L
98
38
34
70
30
40
B
44
68
16
18
O
I
48
46
58
36
60
50
42
66
32
22
10
28
26
52
54
56
62
64

PRESSURIZED GAS CIRCUIT-BREAKER

BACKGROUND OF THE INVENTION

1. Field of the Invention

The present invention concerns a pressurized gas circuit-breaker, in particular a high-voltage circuit-breaker, having an interrupter chamber filled with an insulative gas and in which are disposed a fixed contact member and a mobile contact member cooperating with the latter, and including an operating mechanism connected to the mobile contact member to displace the mobile contact member along an opening travel from a circuit-breaker closed position to an open position.

2. Description of the Prior Art

When pressurized gas circuit-breakers open, large moving masses have to be braked to a stop within a relatively short final section of the opening travel. Particularly rigorous requirements must be satisfied when, in the case of pressurized gas circuit-breakers in the form of puffer piston circuit-breakers, the puffer piston moves with the puffer cylinder in the final section of the opening travel. Circuit-breakers of this type are described in document EP-A1-0 664 552 and in patent application N° EP-94109470.8. In circuit-breakers of this kind the pressure in the pumping space delimited by the puffer cylinder and the puffer piston is not able to exert any braking action on the moving mobile masses. The linkage between the moving masses of the circuit-breaker and the operating mechanism is subject to high pressure forces if the opening-braking device is integrated into the operating mechanism.

Unpublished French patent application N° 95 13479 describes an opening-braking device that has an overall length sufficiently small for it to be integrated into the interrupter chambers of pressurized gas circuit-breakers without it being necessary to increase the length of the latter. This applies even to pressurized gas circuit-breakers of the kind described in document EP-A1-0 664 552 and in patent application EP-94109470.8, in which there is very little space available because of the operating mechanism for displacing the puffer piston. The opening-braking device described in the aforementioned French patent application has a fixed braking cylinder which has a transverse wall at one end and is open at the other end. A connecting rod passes coaxially through the braking cylinder and the transverse wall and connects the mobile contact member of the pressurized gas circuit-breaker to an insulative operating rod that is in turn connected to the operating mechanism. A braking piston which is located outside the space of the cylinder delimited by the braking cylinder when the mobile contact member is in the circuit-breaker closed position can slide in the lengthwise direction on the connecting rod. When the pressurized gas circuit-breaker opens, the braking piston is driven by a drive abutment on the connecting rod in a downstream final section of the opening travel, as the consequence of which the braking piston enters the braking cylinder through its open end. An increase in pressure to brake the closing movement is created in the space of the cylinder delimited by the braking cylinder, the braking piston and the transverse wall. In this opening-braking device, an effective pressure, and therefore effective braking, are obtained only very late, i.e. only a very short time before the open position of the circuit-breaker is reached. Braking is therefore effected in a very short area of the final section, which implies very high braking forces.

Document FR-A-2 246 048 describes a pressurized gas circuit-breaker in the form of a puffer piston circuit-breaker in which a flanged bush is provided at the level of the puffer piston. The bush surrounds the mobile switching member and, on opening, closes the passages between the pumping volume and the puffer nozzle in a final section of the opening travel. When the passages are closed, the pressure rises in the pumping volume and affects the braking. This prior art pressurized gas circuit-breaker has the disadvantage that, due to the closing of the passages, the puffer effect is entirely interrupted, which can have a negative effect on arc extinction and lead to non-optimal use of the extinction gas. This type of opening-braking device cannot be used in puffer piston circuit-breakers, in which the puffer piston moves with the puffer cylinder in the final section of the opening travel.

In a pressurized gas circuit-breaker in the form of a puffer piston circuit-breaker described in document DE-A-30 41 801, a braking effect is also obtained in a final section of the opening travel because the passages between the pumping volume and the puffer nozzle are partly blocked. This has the advantage that the switching path is still subjected to the puffer effect, even if only partially, during braking. However, this opening-braking device cannot be used in a puffer piston circuit-breaker in which the puffer piston moves with the puffer cylinder.

Document EP-A-0 049 375 also described a pressurized gas circuit-breaker in which a braking cylinder is disposed at the base of a support device carrying the interrupter chamber. A braking piston fixed to a connector rod passing coaxially through the braking cylinder is connected at one end to a pneumatic operating mechanism and at the other end to an insulative operating rod connected to the mobile contact member. In the circuit-breaker closed position it is at a certain distance from the open end of the braking cylinder. On opening, when it reaches the final section of the opening travel the braking piston enters the braking cylinder, causing a rise in pressure producing the braking effect. In this prior art pressurized gas circuit-breaker the operating rod is subject to high pressure forces on braking and the opening-braking device must be of considerable length, with the result that it cannot be integrated into the interrupter chamber.

Document DE-A-29 22 913 describes a pressurized gas circuit-breaker, in particular a high-voltage circuit-breaker, having an interrupter chamber filled with an insulative gas and in which are disposed a fixed contact member and a mobile contact member cooperating therewith, having a drive mechanism connected to the mobile contact member to displace the mobile contact member from a circuit-breaker closed position to an open position in the opening direction over an opening travel, having an opening-braking device with a fixed braking cylinder through which a connecting rod disposed between the mobile contact member and the drive mechanism passes in the coaxial direction, and the length of which is less than the opening travel and which has lateral walls at both ends for at least almost gas-tight closing of the cylinder space delimited by the braking cylinder and having, disposed in the cylinder space and on the connecting rod so as to slide in the longitudinal direction, a braking piston that divides the cylinder space into two sub-spaces and is driven by a drive member of the connecting rod in a final section of the opening travel on opening, so that a pressure rise is created in one sub-space and a pressure drop is created in the other sub-space. A device of this kind offers an excellent braking effect in a small overall size, but the acceleration of the braking piston is sudden and causes an impact on the drive member.

An object of the present invention is therefore to propose a pressurized gas circuit-breaker having an opening-braking device offering an excellent braking effect for a small overall size, with progressive and gentle acceleration of the braking piston, preventing any violent impact on the drive member of the braking piston.

SUMMARY OF THE INVENTION

The present invention consists in a pressurized gas circuit-breaker, in particular for high-voltage applications, including an interrupter chamber filled with an insulative gas and in which are disposed a fixed contact member and a mobile contact member cooperating therewith, having a drive mechanism connected to the mobile contact member to displace the mobile contact member from a circuit-breaker closed position to an open position in the opening direction over an opening travel, having an opening-braking device with a fixed braking cylinder through which a connecting rod disposed between the mobile contact member and the drive mechanism passes in the coaxial direction, and the length of which is less than the opening travel and which has lateral walls at both ends for at least almost gas-tight closing of the cylinder space delimited by the braking cylinder and having, disposed in the cylinder space and on the connecting rod so as to slide in the longitudinal direction, a braking piston that divides the cylinder space into two sub-spaces and is driven by a drive member on the connecting rod in a final section of the opening travel during opening, so that a pressure rise is created in one sub-space and a pressure drop is created in the other sub-space, in which circuit-breaker the braking piston is disposed on a bush around the connecting rod and the bush and the connecting rod delimit an annular cylinder space between the drive member and a counter-abutment provided on the bush, so that a pressure is generated on opening to accelerate the braking piston.

In one particular embodiment said braking piston has a valve which maintains a connection for the flow of current between said sub-spaces on displacement of said braking piston in a closing direction opposite said opening direction.

The circuit-breaker comprises a connection for the flow of current between said two sub-spaces when said braking piston has traveled over an initial area of the final section at the time of opening.

The connection is advantageously formed by an enlargement of the free cross-section of said braking cylinder.

The connecting rod is in the form of a tube and has a strangulation connecting said annular cylinder space to said interrupter chamber.

The transverse wall at the downstream end in said opening direction has a valve device adapted, in the event of a reduction in the pressure in the sub-space delimited by said transverse wall relative to the pressure in said interrupter chamber, to connect the latter to the sub-space concerned.

The transverse wall at the downstream end in said opening direction has a strangulation that connects the sub-space delimited by said transverse wall to said interrupter chamber.

The opening-braking device is in said interrupter chamber.

The present invention is described in more detail by means of an embodiment shown in the drawings.

DETAILED DESCRIPTION OF THE INVENTION

Figure 1:
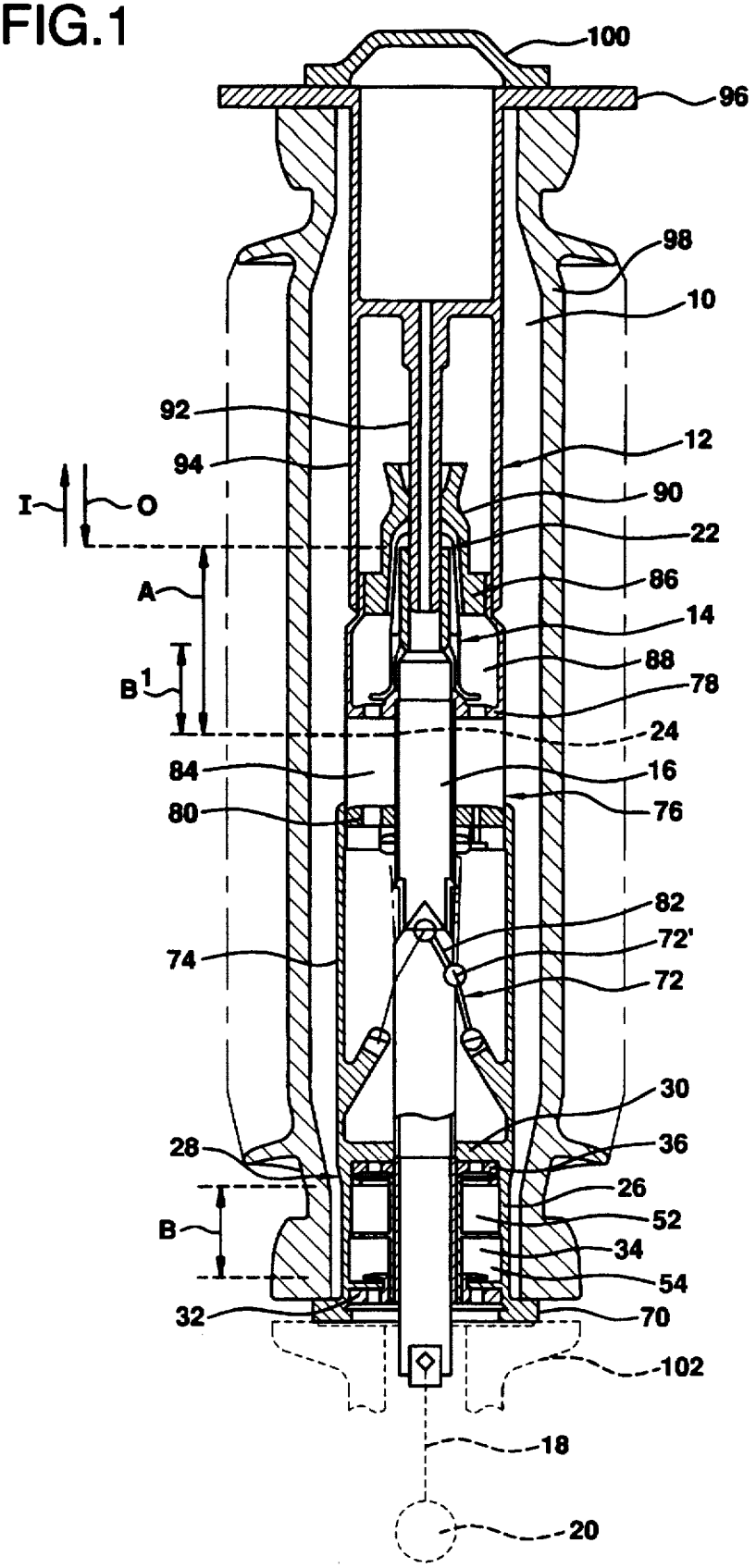
FIG. 1 is a longitudinal section of an interrupter chamber of a pressurized gas circuit-breaker with integral opening-braking device.

FIG. 1 shows partly in longitudinal section one pole of a high-voltage three-pole pressurized gas circuit-breaker. The pressurized gas circuit-breaker is in the form of a puffer piston circuit-breaker and has, inside an interrupter chamber 10, a fixed contact member 12 and a mobile contact member 14. The mobile contact member 14 is fixedly connected to a connecting rod in the form of a tube articulated at the other end to an insulative operating rod 18. The latter is in turn connected to a drive mechanism 20 adapted to displace the mobile contact member 14 from a closed position 22 to an open position, in the opening direction 0, over an opening travel A, to open the circuit-breaker. To close the circuit-breaker the mobile contact member 14 is moved in a closing direction I opposite the opening direction 0, from the open position 24 to the closed position 22.

As shown in FIGS. 2 through 5 in particular, the connecting rod passes coaxially through a fixed circular braking cylinder 26 of an opening-braking device 28. At the end opposite the mobile contact member 14 the braking cylinder 26 has a first transverse wall 30 through which the connecting rod 16 passes in the longitudinal direction in a gas-tight and freely mobile manner. At the end of the braking cylinder 26 opposite the drive mechanism 20 is a disk-shaped second transverse wall 32 surrounding the connecting rod 16 at a certain distance. The length L of the braking cylinder 26 is less than the opening travel A. The two transverse walls 30, 32 and the braking cylinder 26 delimit a cylinder space 34 that is divided into two sub-spaces 38, 40 by a braking piston 36 in the braking cylinder 26.

The braking piston 36 is at the end of a bush 42 that can slide longitudinally on the connecting rod 16, to which it is sealed at both ends. The bush 42 passes longitudinally through the two transverse walls 32, to which it is sealed.

At the other, remote end of the braking piston 36, opposite the drive mechanism 20, the bush 42 has a radially inwardly projecting bead providing a counter-abutment 44. This abutment operates with a drive abutment 46 on the connecting rod 16 formed by a progressive reduction in the outside diameter of the connecting rod 16. At a certain distance from the drive abutment 46 the connecting rod 16 has a strangulation 48 that connects an annular cylinder space 50 delimited by the connecting rod 16 and the bush 42 to the interrupter chamber 10 between the counter-abutment 44 and the drive abutment 46.

In an initial area 52 terminating at the first transverse wall 30 the braking cylinder 26 has an open cross-section that essentially corresponds to the cross-section of the braking piston 36, so that the latter can slide along the cylinder 26 in the initial area 52 in a gas-tight manner. In a final area 54 leading from the initial area 52 at least approximately as far as the second transverse wall 32, the braking cylinder 26 has an enlargement 56 increasing the open cross-section by which the two sub-spaces 38 and 40 are connected together for the flow of current when the braking piston 36 is in the corresponding position. The enlargement 56 therefore forms a connecting passage between the two sub-spaces 38 and 40 only when the braking piston 36 is not in the initial area.

The braking piston 36 has axial passages 58 that can be closed by an annular valve body 60 of the automatic disk valve type. The valve body is on the opposite side of the braking piston 36 to the second transverse wall 32, with the result that the passages 58 are always closed when the pressure in the first subspace 38 between the braking piston 36 and the second transverse wall 32 is higher than that in the second subspace 40 between the braking piston 36 and the first transverse wall 30.

An automatic valve system 62 is also associated with the second transverse wall 32. It has a ring 64 forming a valve body disposed in the first sub-space 38 and resting on the second transverse wall 32. It is designed to close and to open axial inlet passages 36 in the second transverse wall 32 when the pressure in the first sub-space 38 is less than the pressure of the insulative gas in the interrupter chamber 10. The second transverse wall 32 also has a strangulation 68 through which the first sub-space 38 is at all times connected to the interrupter chamber 10. However, since the cross-section of the strangulation 68 is an order of magnitude less than the surface area of the braking piston 36, pressure equalization between the interrupter chamber 10 and the first sub-space 38 can only come about very slowly.

In the embodiment shown the travel B of the braking piston 36 is equal to only about half the opening travel A. Furthermore, as seen in FIGS. 2 to 5, the braking piston co-operates with the initial area 52 of the braking cylinder 26 only over a travel that corresponds to more or less half the braking travel B. The braking piston 36 is driven only in a final section B' of the opening travel A. The length of the final travel B' corresponds to the braking travel B.

The braking cylinder 26 and the first transverse wall 30 are part of a cast aluminum member that further constitutes a connecting flange 70 of the pressurized gas circuit-breaker and on which are further formed articulation points for the cranked lever 72 and a guide cylinder 74 for a puffer cylinder 76. A puffer piston 80 can slide freely in the lengthwise direction in the puffer cylinder 76, to which it is sealed. The connecting rod 16 is freely moveable in but sealed to a central opening in the puffer piston 80. The puffer piston 80 is articulated to the cranked lever 72, on which an oscillating link 82 articulated at the other end to the connecting rod 16 operates at the articulation 72'.

The puffer cylinder 76 has a diaphragm 78 that delimits a pumping space on one side with the skirt of the puffer cylinder and the pump piston 80 and a puffer space 88 on the other side with the cylinder skirt and a cylinder end wall 86. The diaphragm 78 is fixed to the connecting rod 16 at this end and the mobile contact member 14 is disposed on it, its free end portion passing through a passage in the cylinder end wall 86. The cylinder end wall 86 is made of an insulative material, preferably PTFE, and has formed on it a puffer nozzle 90 which surrounds at a certain distance the end portion of the mobile contact member 14. Automatic valves are associated with the diaphragm 78 and the pump piston 80.

The fixed contact member 12 has a tubular central spark guard contact member 92 which, in the closed position 22, passes through the narrow part of the puffer nozzle 90 into the U-shape mobile contact member 14. The spark guard contact member 92 is surrounded coaxially and at a certain distance by a contact tube 92 which, in the circuit-breaker closed position, co-operates with the puffer cylinder 76 to conduct a substantial part of the current flowing through the circuit-breaker. The spark guard contact member 92 is supported by strips on the contact tube 94 which is in turn disposed on a second connecting flange 96. The first connecting flange 70 and the second connecting flange 96 are each fixed to one end of an interrupter chamber insulator 98 which delimits the interrupter chamber 10. A cover 100 sealed to the second connecting flange 96 closes the top end of the interrupter chamber 10. The bottom end of the latter is electrically connected by passages (not shown) in the connecting flange 70 to the interior of an insulative support device 102. The operating rod 18 enters the latter as far as the drive mechanism 20. An insulative gas, preferably SF6, at a particular reduced pressure relative to atmospheric pressure is contained within the interrupter chamber 10 and the insulative support device 102.

With regard to the structure and the mode of operation of the puffer cylinder 76, the puffer piston 80 and the control of their displacement by means of the cranked lever 72, explicit reference is made here to European patent application N° 94109470.8. The above document merely mentions that the puffer piston 80 remains essentially immobile during opening, until the diaphragm 78 is close to it after moving in the opening direction 0, and that the puffer cylinder 76 and the puffer piston 80 move together in the opening direction 0 until the open position 24 is reached.

Figure 2:
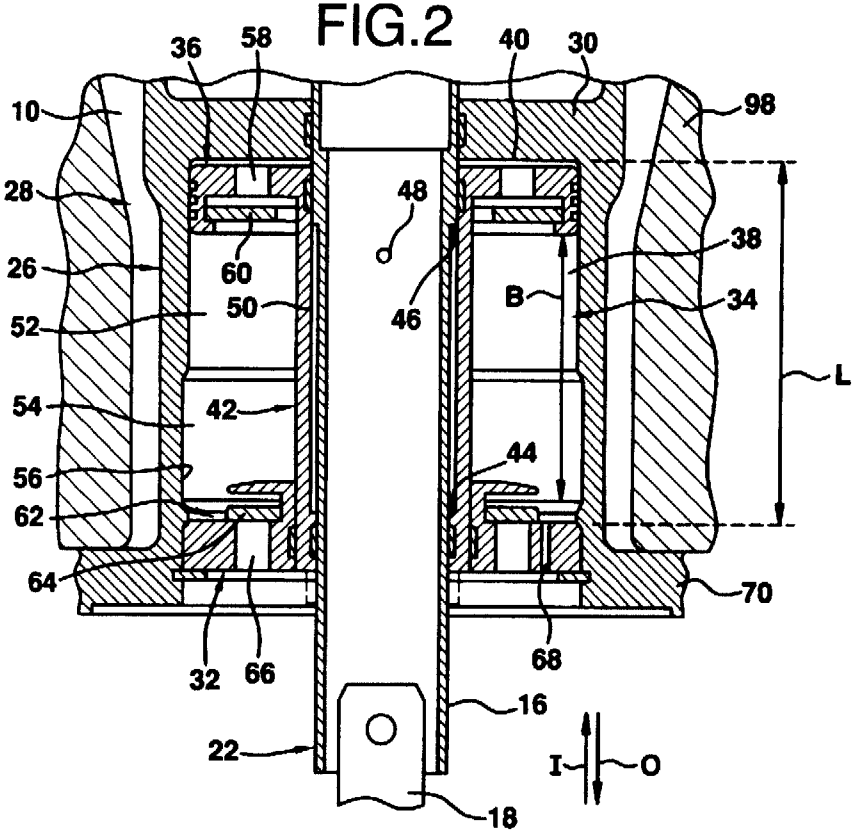
FIG. 2 shows the opening-braking device from FIG. 1 to a larger scale in the closed position of the mobile contact member.

The mode of operation of the pressurized gas circuit-breaker of the invention will now be explained in more detail with the assistance of FIGS. 2 to 5. In FIGS. 1 and 2, the mobile contact member 14 is in the closed position 22. The braking piston 36 is also in an end or travel position near the first transverse wall, in which position the first sub-space 38 has a maximal volume and the second sub-space 40 has a minimal volume. Given that, because of its weight, the valve body 60 is remote from the braking piston 36, the passages 58 are open with the result that the pressure in the two sub-spaces 38 and 40 is the same. Because of its weight, the ring 64 is at the level of the second lateral wall 32 and closes the inlet passages 66. Because of the electrical connection via the strangulations 68, the pressure in the space of the cylinder 26 corresponds to the pressure in the interrupter chamber 10.

If the operating mechanism 20 receives an open instruction, it pulls the mobile contact member 14 in the opening direction 0. As the mobile contact member 14 and the puffer cylinder 76 traverse approximately half the opening travel A the puffer piston 80 remains immobile, with the result that the gas in the pumping space 84 is pressurized and displaced into the puffer space 88. As soon as the mobile contact member 14 separates from the fixed spark guard contact member 92 the pressurized gas begins to blow out the electrical arc in the puffer nozzle 90. Finally, the pump piston 80 moves with the puffer cylinder 76 in the opening direction 0, the electrical arc continuing to be blown out by the remaining insulative gas at reduced pressure in the puffer space 88.

Given that the braking piston 36 is driven first by the connecting rod 16, after an opening distance corresponding to the difference between the opening travel A and the braking travel B has been traversed, the mobile contact member 14 reaches a high speed, conferring good extinction properties on the pressurized gas circuit-breaker.

Figure 3:
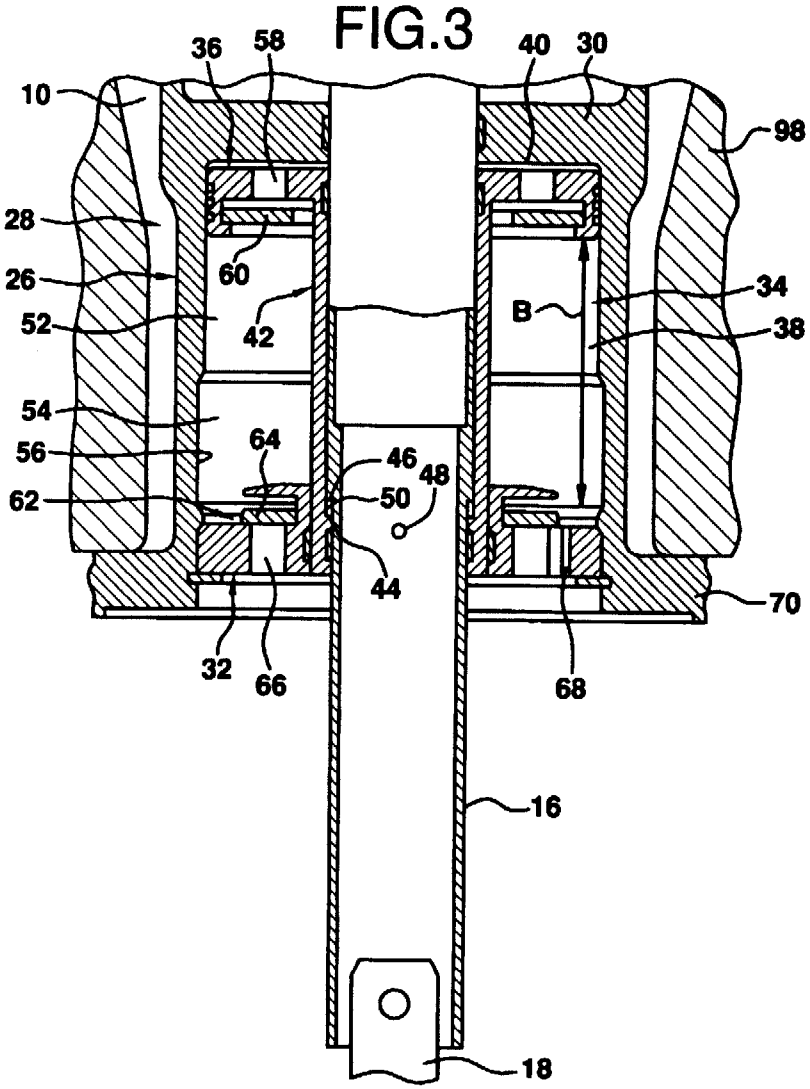
FIG. 3 is a representation of the opening-braking device identical to that of FIG. 2, during opening, just before the mobile contact member reaches a final section of the opening travel and movement is imparted to the braking piston.

FIG. 3 relates to a position of the mobile contact member 14 in which the drive abutment 46 has moved to within a short distance of the counter-abutment 44. The cylinder space 50 has been reduced in size by the relative displacement of the fixed bush 42 and the connecting rod 16, the pressure obtained rising slowly and progressively, however, because of the strangulation 48, but increasing very rapidly once the strangulation 48 is closed by the bead forming the counter-abutment. FIG. 3 shows the moment at which the pressure in the annular cylinder space 50 causes continuous acceleration of the braking piston 36 in the opening direction 0, so that the drive abutment 46 does not strike the fixed counter-abutment 44 at full speed.

Immediately the drive abutment 46 has reached the counter-abutment 44, the braking piston 36 is mechanically driven in the opening direction 0 by the connecting rod 16. Because of this displacement the pressure rises in the first sub-space 38 and falls in the second sub-space 40, the valve body 60 which at this time is level with the braking piston 36 preventing equalization of the pressure. Because of the fast acceleration of the braking piston 36 and the inertia of the valve body 60, the passages 58 are closed very rapidly. Because the pressure in the second sub-space 40 falls rapidly and because of the increased pressure in the first sub-space 38, a considerable braking force is exerted very rapidly on the connecting rod 16, until the braking piston 36 descends as far as the initial area 52 of the braking cylinder 26. At this time, shown in FIG. 4, the speed of the mobile contact member 14 has slowed to a very low value.

The braking force is reduced by the subsequent reversing of the braking piston 36, which prevents significant intervention of transient forces and has a vibration damping effect.

Figure 5:
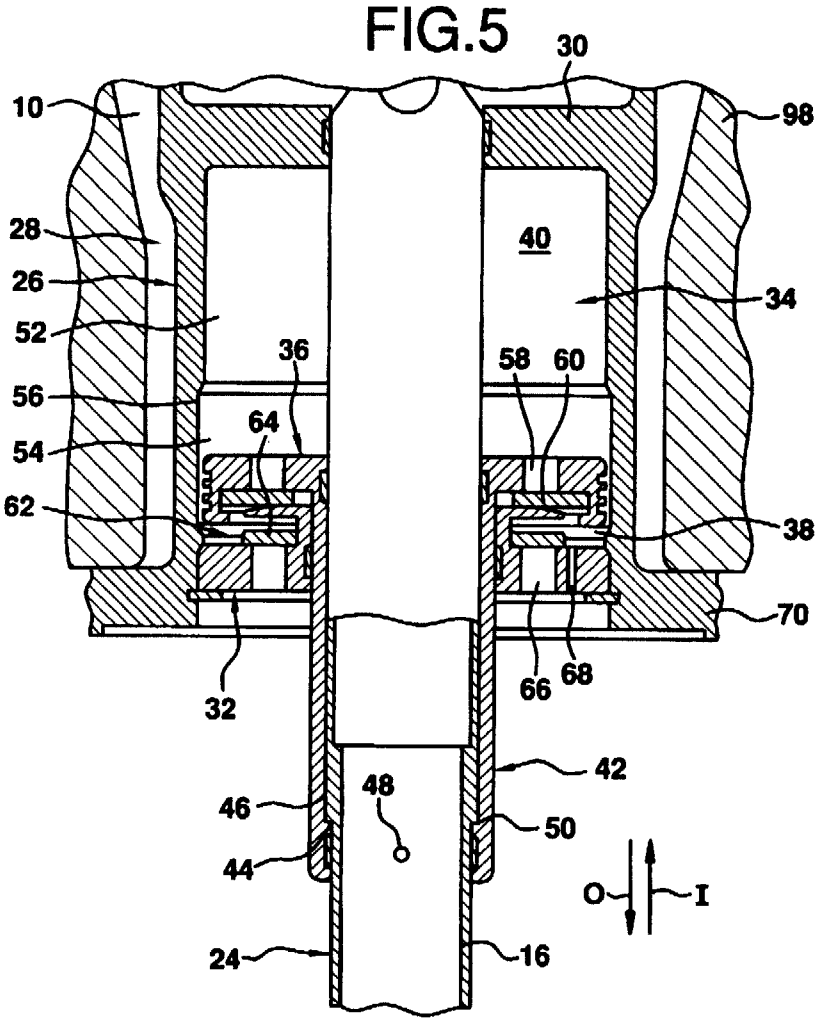
FIG. 5 is a representation of the opening-braking device identical to that of FIGS. 2, 3 and 4, in the open position of the mobile contact member.
Figure 4:
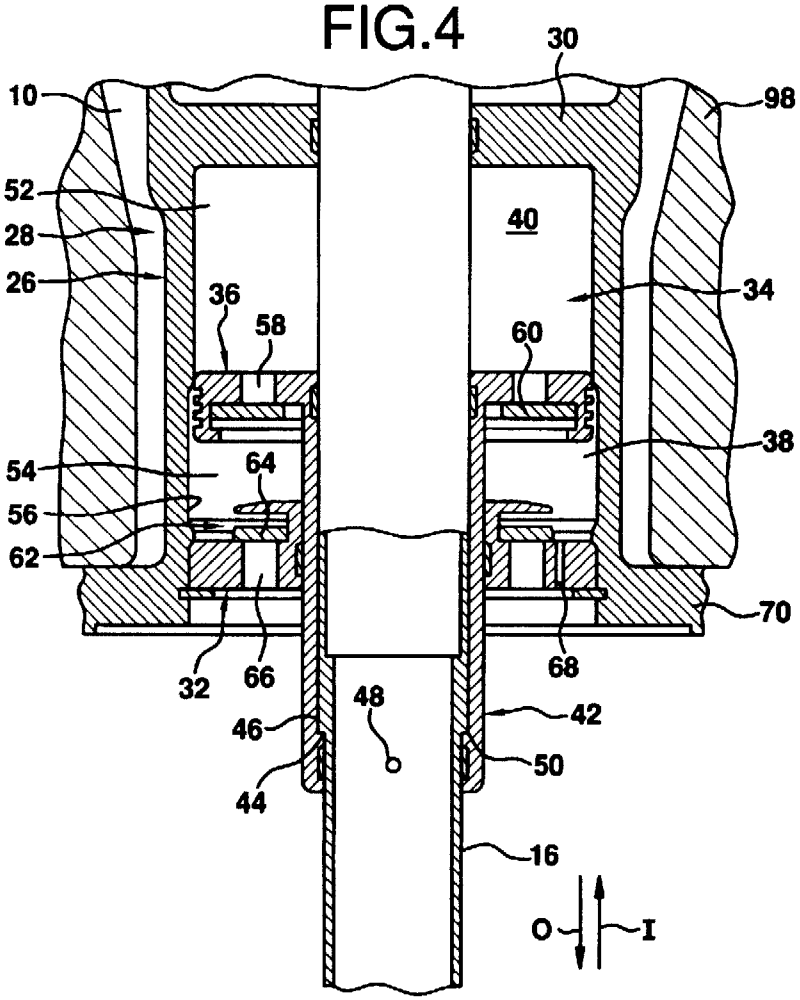
FIG. 4 is a representation of the opening-braking device identical to that of FIGS. 2 and 3, during opening, just before the mobile contact member reaches the open position.

In FIG. 5, the mobile contact member 14 is in the closed position 24, the braking piston 36 supported by the valve body 60 resting on a half-flange of the second transverse wall 32 for the ring 64.

On closing, the connecting rod 60 is moved in the closing direction I. Since, as shown in FIG. 5 in particular, the strangulation 48 is closed in the circuit-breaker open position, and because of the reduced pressure in the annular cylinder space 50, the bush 42 moves downwards, due to gravity alone, i.e. in the closing direction I, until the braking piston 36 is level with the second transverse wall 30. There is virtually no force created by a pressure difference to oppose this movement, since rapid equalization of pressure between the sub-spaces 38, 40 and between the switching chamber 10 and the first sub-space 38 is made possible because of the valve body 60, which is raised by the braking piston 36, and the valve device 62. In this context, it should also be mentioned that accelerations and speeds on closing are significantly lower than on opening. If the braking piston 36 is at the level of the first transverse wall 30, the strangulation 48 is uncovered by the relative displacement of the fixed bush 42 and the connecting rod 16 and the opening-braking device 28 is then ready for the next opening sequence.

If the braking piston 36 must be mechanically driven in the direction of the transverse wall 30 during closing, it is possible to provide a drive member for the bush 42 on the connecting rod 16, as shown in dashed outline in FIG. 2.

It is also feasible for the free cross-section of the braking cylinder 26 to be constant along its entire length, and to install longitudinally off-center nuts on the braking cylinder 26 in the final area 54.

It is also possible to dispense with the valve device 62 in the second transverse wall 32.

There is claimed:

1. A pressurized gas circuit-breaker, for high-voltage applications, comprising:

an interrupter chamber filled with an insulative gas and in which are disposed a fixed contact member and a mobile contact member cooperating therewith;

a drive mechanism connected to the mobile contact member to displace the mobile contact member from a circuit-breaker closed position to an open position in an opening direction over an opening travel; and an opening-braking device with a fixed braking cylinder through which a connecting rod disposed between the mobile contact member and the drive mechanism passes in a coaxial direction, the braking cylinder having a length of which is less than the opening travel and which has lateral walls at both ends for at least almost gas-tight closing of a cylinder space delimited by the braking cylinder, and having, disposed in the cylinder space and on the connecting rod so as to slide in a longitudinal direction, a braking piston that divides the cylinder space into two sub-spaces and is driven by a drive abutment on the connecting rod in a final section of the opening travel during opening, so that a pressure rise is created in one sub-space and a pressure drop is created in the other sub-space, wherein the braking piston is disposed on a bush around the connecting rod and the bush and the connecting rod delimit an annular cylinder space between the drive abutment and a counter-abutment on the bush, so that a pressure is generated on opening to accelerate the braking piston.

2. The pressurized gas circuit-breaker claimed in claim 1, wherein said braking piston has a valve which maintains a connection for current flow between said sub-spaces on displacement of said braking piston in a closing direction opposite said opening direction.

3. The pressurized gas circuit-breaker as claimed in claim 1, further comprising a connection for current flow between said two sub-spaces when said braking piston has traveled over an initial area of the final section at the time of opening.

4. The pressurized gas circuit-breaker claimed in claim 3, wherein said connection is formed by an enlargement of a free cross-section of said braking cylinder.

5. The pressurized gas circuit-breaker claimed in claim 4, wherein said connecting rod comprises a tube and has a strangulation connecting said annular cylinder space to said interrupter chamber.

6. The pressurized gas circuit-breaker claimed in claim 1, wherein one of said lateral walls at a downstream end in said opening direction has a valve device operative, upon occurrence of a reduction in the pressure in one of the two sub-spaces delimited by said one of said lateral walls relative to the pressure in said interrupter chamber, to connect the interrupter chamber to the one of the two sub-spaces.

7. The pressurized gas circuit-breaker claimed in claim 1, wherein one of said lateral walls at a downstream end in said opening direction has a strangulation that connects one of the two sub-spaces delimited by said one of said lateral walls to said interrupter chamber.

8. The pressurized gas circuit-breaker claimed in claim 1, wherein said opening-braking device is in said interrupter chamber.

9. A pressurized gas circuit-breaker, for high-voltage applications, comprising:

an interrupter chamber filled with an insulative gas and in which are disposed a fixed contact member and a mobile contact member cooperating therewith;

a drive mechanism connected to the mobile contact member to displace the mobile contact member from a circuit-breaker closed position to an open position in an opening direction over an opening travel; and an opening-braking device with a fixed braking cylinder through which a connecting rod disposed between the mobile contact member and the drive mechanism passes in a coaxial direction, the braking cylinder having a length of which is less than the opening travel and which has lateral walls at both ends for at least almost gas-tight closing of a cylinder space delimited by the braking cylinder, and having, disposed in the cylinder space and on the connecting rod so as to slide in a longitudinal direction, a braking piston that divides the cylinder space into two sub-spaces and is driven by a drive member on the connecting rod in a final section of the opening travel during opening, so that a pressure rise is created in one sub-space and a pressure drop is created in the other sub-space, wherein the braking piston is disposed on a bush around the connecting rod and the bush and the connecting rod delimit an annular cylinder space between the drive member and a counter-abutment on the bush, so that a pressure is generated on opening to accelerate the braking piston, wherein said braking piston has a valve which maintains a connection for current flow between said sub-spaces on displacement of said braking piston in a closing direction opposite said opening direction.

10. A pressurized gas circuit-breaker, for high-voltage applications, comprising:

an interrupter chamber filled with an insulative gas and in which are disposed a fixed contact member and a mobile contact member cooperating therewith;

a drive mechanism connected to the mobile contact member to displace the mobile contact member from a circuit-breaker closed position to an open position in an opening direction over an opening travel; and an opening-braking device with a fixed braking cylinder through which a connecting rod disposed between the mobile contact member and the drive mechanism passes in a coaxial direction, the braking cylinder having a length of which is less than the opening travel and which has lateral walls at both ends for at least almost gas-tight closing of a cylinder space delimited by the braking cylinder, and having, disposed in the cylinder space and on the connecting rod so as to slide in a longitudinal direction, a braking piston that divides the cylinder space into two sub-spaces and is driven by a drive member on the connecting rod in a final section of the opening travel during opening, so that a pressure rise is created in one sub-space and a pressure drop is created in the other sub-space, wherein the braking piston is disposed on a bush around the connecting rod and the bush and the connecting rod delimit an annular cylinder space between the drive member and a counter-abutment on the bush, so that a pressure is generated on opening to accelerate the braking piston, wherein the pressurized gas circuit-breaker further comprises a connection for current flow between said two sub-spaces when said braking piston has traveled over an initial area of the final section at the time of opening, and wherein said connection is formed by an enlargement of a free cross-section of said braking cylinder.

11. The pressurized gas circuit-breaker claimed in claim 10, wherein said connecting rod is in the form of a tube and has a strangulation connecting said annular cylinder space to said interrupter chamber.

12. A pressurized gas circuit-breaker, for high-voltage applications, comprising:

an interrupter chamber filled with an insulative gas and in which are disposed a fixed contact member and a mobile contact member cooperating therewith;

a drive mechanism connected to the mobile contact member to displace the mobile contact member from a circuit-breaker closed position to an open position in an opening direction over an opening travel; and an opening-braking device with a fixed braking cylinder through which a connecting rod disposed between the mobile contact member and the drive mechanism passes in a coaxial direction, the braking cylinder having a length of which is less than the opening travel and which has lateral walls at both ends for at least almost gas-tight closing of a cylinder space delimited by the braking cylinder, and having, disposed in the cylinder space and on the connecting rod so as to slide in a longitudinal direction, a braking piston that divides the cylinder space into two sub-spaces and is driven by a drive member on the connecting rod in a final section of the opening travel during opening, so that a pressure rise is created in one sub-space and a pressure drop is created in the other sub-space, wherein the braking piston is disposed on a bush around the connecting rod and the bush and the connecting rod delimit an annular cylinder space between the drive member and a counter-abutment on the bush, so that a pressure is generated on opening to accelerate the braking piston, wherein one of said lateral walls at a downstream end in said opening direction has a valve device operative, upon occurrence of a reduction in the pressure in one of the two subspaces delimited by said one of said lateral walls relative to the pressure in said interrupter chamber, to connect the interrupter chamber to the one of the two sub-spaces.

13. A pressurized gas circuit-breaker, for high-voltage applications, comprising:

an interrupter chamber filled with an insulative gas and in which are disposed a fixed contact member and a mobile contact member cooperating therewith;

a drive mechanism connected to the mobile contact member to displace the mobile contact member from a circuit-breaker closed position to an open position in an opening direction over an opening travel; and an opening-braking device with a fixed braking cylinder through which a connecting rod disposed between the mobile contact member and the drive mechanism passes in a coaxial direction, the braking cylinder having a length of which is less than the opening travel and which has lateral walls at both ends for at least almost gas-tight closing of a cylinder space delimited by the braking cylinder, and having, disposed in the cylinder space and on the connecting rod so as to slide in a longitudinal direction, a braking piston that divides the cylinder space into two sub-spaces and is driven by a drive member on the connecting rod in a final section of the opening travel during opening, so that a pressure rise is created in one sub-space and a pressure drop is created in the other sub-space, wherein the braking piston is disposed on a bush around the connecting rod and the bush and the connecting rod delimit an annular cylinder space between the drive member and a counter-abutment on the bush, so that a pressure is generated on opening to accelerate the braking piston, wherein one of said lateral walls at a downstream end in said opening direction has a strangulation that connects one of the two sub-spaces delimited by said one of said lateral walls to said interrupter chamber.

14. A pressurized gas circuit-breaker, for high-voltage applications, comprising:

an interrupter chamber filled with an insulative gas and in which are disposed a fixed contact member and a mobile contact member cooperating therewith;

a drive mechanism connected to the mobile contact member to displace the mobile contact member from a circuit-breaker closed position to an open position in an opening direction over an opening travel; and an opening-braking device with a fixed braking cylinder through which a connecting rod disposed between the mobile contact member and the drive mechanism passes in a coaxial direction, the braking cylinder having a length of which is less than the opening travel and which has lateral walls at both ends for at least almost gas-tight closing of a cylinder space delimited by the braking cylinder, and having, disposed in the cylinder space and on the connecting rod so as to slide in a longitudinal direction, a braking piston that divides the cylinder space into two sub-spaces and is driven by a drive member on the connecting rod in a final section of the opening travel during opening, so that a pressure rise is created in one sub-space and a pressure drop is created in the other sub-space, wherein the braking piston is disposed on a bush around the connecting rod and the bush and the connecting rod delimit an annular cylinder space between the drive member and a counter-abutment on the bush, so that a pressure is generated on opening to accelerate the braking piston, wherein said opening-braking device is in said interrupter chamber.

* * * * *